US005893787A

United States Patent [19]

Chan et al.

[11] Patent Number: 5,893,787

[45] Date of Patent: Apr. 13, 1999

[54] APPLICATION OF FAST ETCHING GLASS FOR FED MANUFACTURING

[75] Inventors: Lap Chan, San Francisco, Calif.; Simon Chooi, Singapore, Singapore

[73] Assignee: Chartered Semiconductor Manufacturing, Ltd., Singapore, Singapore

[21] Appl. No.: 08/805,877

[22] Filed: Mar. 3, 1997

[51] Int. Cl.[6] ..... H01J 9/02

[52] U.S. Cl. ..... 445/24

[58] Field of Search ..... 445/24, 50

[56] References Cited

U.S. PATENT DOCUMENTS

| | | | |
|---|---|---|---|
| 5,219,310 | 6/1993 | Tomo et al. | 445/24 |
| 5,372,973 | 12/1994 | Doan et al. | 437/228 |
| 5,461,009 | 10/1995 | Huang et al. | 437/228 |
| 5,499,938 | 3/1996 | Nakamoto et al. | 445/50 |

*Primary Examiner*—Kenneth J. Ramsey

*Attorney, Agent, or Firm*—George O. Saile; Stephen B. Ackerman

[57] ABSTRACT

The microtip housing cavity in a cold cathode display was formed by selecting for the dielectric layer surrounding it a material whose etch rate (for the same etchant) was 3 to 20 times faster than the etch rate of the gate layer. Specifically, a gaseous etchant that included $CHF_3$, $CH_4$, CO, or CO and $C_4F_8$ was used to form the cavity in a layer consisting of silicon oxide containing between about 3 and 10 weight % boron and between about 3 and 10 weight % phosphorus, deposited by chemical vapor deposition at pressures somewhat less than atmospheric (commonly referred to as SABPSG or sub-atmospheric boro-phosphosilicate glass). The gate layer consisted of phosphorus-doped polysilicon. Using this combination, once the gate opening had been etched, etching of the cavity proceeded very rapidly with little increase in the width of the gate opening. Thus the cavity was formed in a single mask, single etchant process.

19 Claims, 1 Drawing Sheet

APPLICATION OF FAST ETCHING GLASS FOR FED MANUFACTURING

BACKGROUND OF THE INVENTION

1. Field of the Invention

The invention relates to the general field of field emission devices, more particularly to the formation of the microtip cavity.

2. Description of the Prior Art

Cold cathode electron emission devices are based on the phenomenon of high field emission wherein electrons can be emitted into a vacuum from a room temperature source if the local electric field at the surface in question is high enough. The creation of such high local electric fields does not necessarily require the application of very high voltage, provided the emitting surface has a sufficiently small radius of curvature.

The advent of semiconductor integrated circuit technology made possible the development and mass production of arrays of cold cathode emitters of this type. In most cases, cold cathode field emission displays comprise an array of very small conical emitters, each of which is connected to a source of negative voltage via a cathode conductor line or column. Another set of conductive lines (called gate lines) is located a short distance above the cathode lines at an angle (usually 90°) to them, intersecting with them at the locations of the conical emitters or microtips, and connected to a source of positive voltage. Both the cathode and the gate line that relate to a particular microtip must be activated before there will be sufficient voltage to cause cold cathode emission.

In FIG. 6 we show, in schematic cross-section, the basic elements of a single field emission device (FED). A portion of a cathode column is shown as layer 2 on the surface of insulating substrate 1. Located on layer 2 is microtip 51, typically a cone of height about one micron and base diameter about one micron and comprising molybdenum or silicon, though other materials may also be used. In many embodiments of the prior art, local ballast resistors (not shown here) may be in place between the cone and the cathode column.

A hole in layer 4, directly over the microtip 51 allows streams of electrons to emerge from the tips when sufficient voltage is applied. Because of the local high fields right at the surface of the microtips, relatively modest voltages, of the order of 100 volts are sufficient. It will be noted that a cavity (designated 61) has been formed in dielectric layer 3 in order to house microtip 51. In the present invention we will be concerned with improved methods for forming such a cavity.

In the prior art, it is standard practice to form the microtip housing cavity in two separate steps. First, a hole is etched in the gate layer (layer 4 in FIG. 6) then, using a different etchant, layer 4 serves as a mask while layer 3 (also in FIG. 6) is etched. The second etchant is chosen so as not to attack layer 4 so etching can be allowed to proceed for long enough to expose enough of layer 2 to form a base for microtip 51 and to cause significant undercutting of layer 4.

A good description of this prior art method of forming the cavity is given in Huang et al. (U.S. Pat. No. 5,461,009 October 1995). Their equivalent of layer 3 in FIG. 6 is composed of silicon or aluminum oxide while their equivalent of our layer 4 is composed of silicon nitride.

The invention of Doan et al. (U.S. Pat. No. 5,372,973 December 1994) is primarily concerned with how to minimize the gate to tip spacing. To this end, the microtip is formed first and then the cavity is formed around it. This makes for a self-aligning process. Depending on the choice of materials, the cavity may be significantly larger than the microtip or be confined to a small volume near the surface of the microtip.

Nakamoto et al. (U.S. Pat. No. 5,499,938 March 1996) are mostly concerned with novel methods for forming the microtips. Like Doan et al., they form the microtip first and then build the cavity around it.

SUMMARY OF THE INVENTION

It has been an object of the present invention to provide an improved method for forming the microtip housing cavity in a cold cathode display.

A further object of the present invention has been to form both the gate opening and said cavity using a single etch mask.

Yet another object of the present invention has been to form both the gate opening and said cavity using a single etchant.

These objects have been achieved by selecting for the dielectric layer in which the microtip housing cavity was formed a material whose etch rate (for the same etchant) was 3 to 20 times faster than the etch rate of the gate layer. Specifically, a gaseous etchant that includes $CHF_3$ and $CH_4$ and, optionally, CO with $C_4F_8$ (butene), was used to form the cavity in a layer consisting of silicon oxide containing between about 3 and 10 weight % boron and between about 3 and 10 weight % phosphorus, deposited by chemical vapor deposition at pressures somewhat less than atmospheric (commonly referred to as SABPSG or sub-atmospheric boro-phosphosilicate glass). The gate layer consisted of phosphorus-doped polysilicon. Using this combination, once the gate opening had been etched, etching of the cavity proceeded very rapidly with little increase in the width of the gate opening.

DESCRIPTION OF THE PREFERRED EMBODIMENTS

Although we will describe the method of the present invention in terms of forming a single FED, it will be understood that, in practice, many such cells are formed simultaneously. Furthermore, these cells are linked to each other as part of an overall cold emission display. In the full display, cathode columns are first formed by depositing a layer of conductive material onto an insulating substrate and then patterning and etching it. This is followed by a dielectric layer and then a gate layer which is formed into gate lines that run orthogonally to the cathode columns. This is followed by the etching of openings in the gate lines to form the cavities in which the microtips will be housed and finally the microtips are formed inside the cavities in a manner to be described below.

Figure 1:
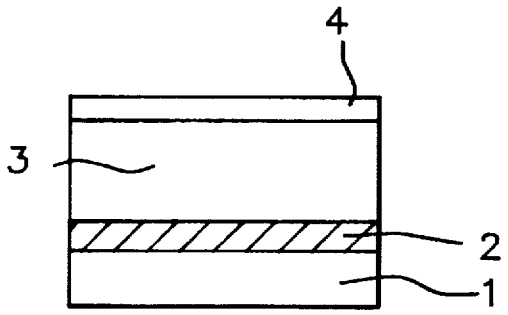
FIGS. 1 through 3 illustrate how a microtip housing cavity for a FED can be formed using only a single etching step.

We now begin a description of the specific method that constitutes our invention. Referring to FIG. 1, conductive cathode layer 2 is deposited on the upper surface of substrate 1 where it will be formed into a series of parallel lines that will serve the function of cathode columns for the display. Our preferred material for layer 2 has been tungsten silicide on phosphorus doped polysilicon but other materials such as P-doped polysilicon alone could also be used. The thickness of layer 2 is between about 500 and 5,000 Angstroms.

Dielectric layer 3 is then deposited on layer 2 followed by gate layer 4. Layer 3 (in which the cavity is to be formed) is between about 0.5 and 2 microns thick while layer 4 is between about 500 and 5,000 Angstroms thick. Layer 4 is most commonly phosphorus doped polysilicon. The material that makes up layer 3 is chosen so that its etch rate (for an etchant such as a gaseous mixture that includes trifluoromethane and carbon tetrafluoride and, optionally, carbon monoxide and butene) is 3 to 20 times faster than that of layer 4.

The relevant parameters associated with the etching were as follows: Chamber pressure 50–500 mTorr; power 500–2000 watts; $CHF_3$ and $CF_4$ flow at 10–100 SCCM; Ar flow at 50–800 SCCM. This may be used alone or in combination with CO and/or $C_4E_8$ as follows:

1) Chamber pressure 20–400 mTorr; power 500–2,000 watts; $CHF_3$ and $CF_4$ flow at 5–30 SCCM; Ar flow at 50–800 SCCM; CO flow at 50–500 SCCM.

2) Chamber pressure 150 mTorr; power 1,500 watts; $CF_4$ and $C_4F_8$ flow at 5 SCCM; Ar flow at 600 SCCM; CO flow at 150 SCCM.

In order to achieve the above-mentioned difference in etch rate between the two layers, the composition and deposition method for layer 3 must be carefully chosen. We have found that a glass-like material, consisting of silicon oxide containing between about 3 and 10 weight % boron and between about 3 and 10 weight % phosphorus, has the necessary properties. To deposit the material (layer 3) we have used chemical vapor deposition at pressures somewhat less than atmospheric. Specifically, we have used ozone, tetraethylorthosilicate, triethylborate, and triethylphosphate, heated to a temperature between about 400 and 600° C. at a pressure between about 100 and 500 Torr.

Figure 2:
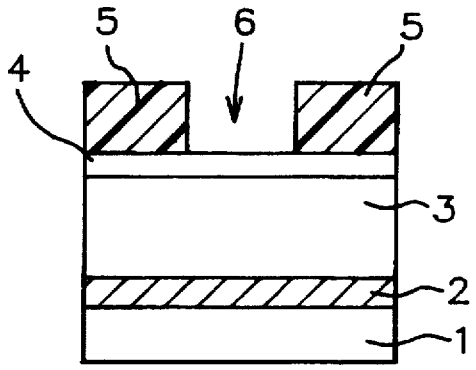
Figure 3:
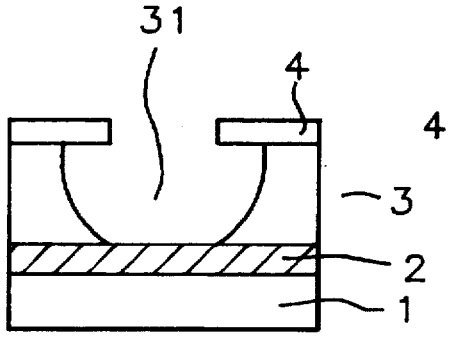

FIG. 2 shows the next step in the process which is to coat layer 4 with photoresist layer 5 in which opening 6 is formed in the usual way (exposure through a mask followed by development). Once mask 5 is in place, etching (as described above) is initiated. Using a single etchant, first the unprotected portions of layer 4 are removed relatively slowly and then, when the etchant reaches layer 3, the etch rate rapidly increases (as described above). The result is that cavity 31 (FIG. 3) soon forms, including significant undercutting of layer 4, with only a slight increase in the width of the hole already etched in layer 4.

At this point an optional cleanup etch using dilute hydrofluoric acid or an ammonium hydroxide/peroxide solution may be used. This additional procedure is not essential for the invention to work but may be elected for removal of any polymer that may have been formed on the surface as a byproduct of the etching process.

Figure 4:
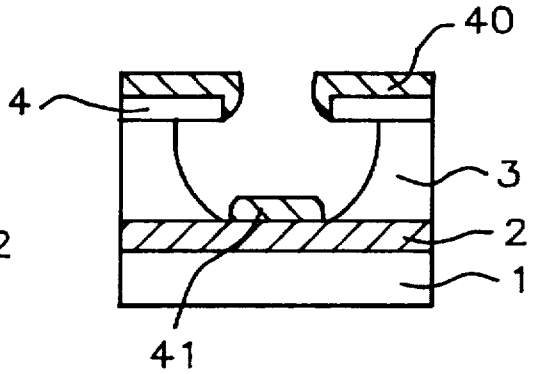
FIG. 4 illustrates the structure of FIG. 3 to which a parting layer has been added.

Once cavity 31 has been formed, the next step is formation of the microtips. Referring to FIG. 4, parting layer 40 is deposited onto layer 4 by means of sputtering or similar technique. A certain amount of the parting layer finds its way inside the cavity to form layer 41. For the parting layer we have typically used titanium nitride, but any similar materials such as tungsten nitride, tantalum nitride, or pure titanium could be used, its purpose being to allow easy liftoff of the next layer. Its thickness is between about 500 and 2,000 Angstroms.

Figure 5:
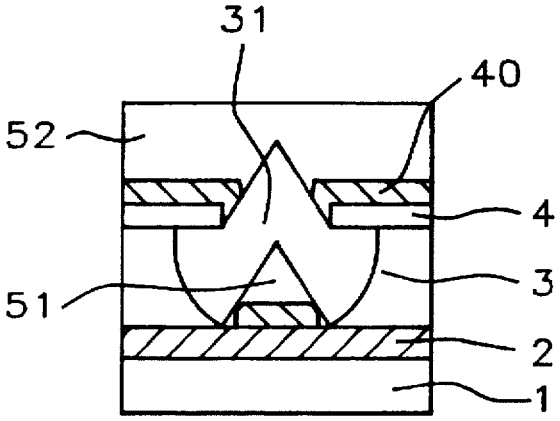
FIG. 5 shows how a microtip is formed inside the housing cavity.

Then, under vacuum, a stream of evaporated conductive material, such as molybdenum, silicon, tungsten, graphite, or diamond, is directed at the structure at an oblique angle of incidence while at the same time rotating the structure about an axis normal to its surface. The result of this procedure is that small cone 51 (FIG. 5) is formed inside cavity 31. In addition, there is a build-up of material (layer 52) on the top surface of parting layer 40. Evaporation is terminated when the original shadowing effects of the opening to 31 cease to play a role and layer 52 becomes continuous.

Figure 6:
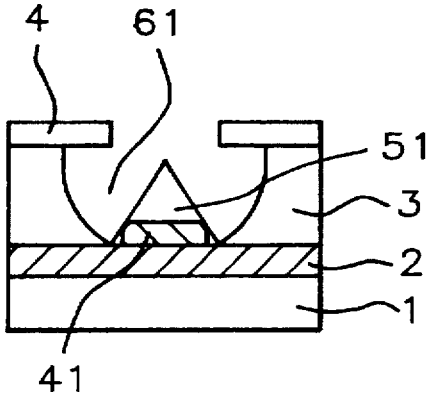
FIG. 6 shows the finished FED cell.

Finally, layer 52 is removed by etching in dilute hydrofluoric acid or an ammonium hydroxide/peroxide solution which attacks parting layer 40, causing layer 52 to lift off. The structure now has the appearance shown in FIG. 6.

While the invention has been particularly shown and described with reference to the preferred embodiments thereof, it will be understood by those skilled in the art that various changes in form and details may be made without departing from the spirit and scope of the invention.

What is claimed is:

1. A method for forming a cavity to house a microtip, comprising:

providing a substrate;

depositing a cathode layer on said substrate;

depositing a dielectric layer on said cathode layer;

depositing a conductive gate layer, thinner than said dielectric layer, on said dielectric layer;

through a mask, etching the conductive gate layer with an etchant having an etch rate, for the dielectric layer, that is between about 3 and 20 times faster than its etch rate for the conductive gate layer; and continuing said etching process until material from the dielectric layer has been removed down to the level of the cathode layer, thereby forming the cavity.

2. The method of claim 1 wherein the conductive gate layer is phosphorus-doped polysilicon.

3. The method of claim 2 wherein the dielectric layer comprises boron, phosphorus, and silicon oxides and said etchant is taken from the group consisting of trifluoromethane, carbon tetrafluoride, carbon monoxide, and butene gases.

4. The method of claim 3 wherein the concentration of boron is between about 3 and 10 weight % and the concentration of phosphorus is between about 3 and 10 weight %.

5. The method of claim 3 wherein said dielectric layer is formed from ozone, tetraethylorthosilicate, triethylborate, and triethylphosphate, heated to a temperature between about 400 and 600° C. at a pressure between about 100 and 500 Torr.

6. The method of claim 1 wherein the conductive gate layer is deposited to a thickness between about 500 and 5,000 Angstroms.

7. The method of claim 1 wherein the dielectric layer is deposited to a thickness between about 0.5 and 2 microns.

8. The method of claim 3 further comprising etching in dilute hydrofluoric acid after the cavity has been formed.

9. A method for manufacturing a cold cathode array comprising:

providing an insulating substrate having an upper surface;

forming cathode columns on the upper surface of said substrate;

depositing a dielectric layer on said upper surface and on said cathode columns;

depositing a conductive gate layer on said dielectric layer;

forming, on said conductive gate layer, a photoresist mask having holes that are evenly spaced and located above the cathode columns;

through said mask, etching the conductive gate layer with an etchant having an etch rate, for the dielectric layer, that is between about 3 and 20 times faster than its etch rate for the conductive gate layer;

continuing said etching process until material from the dielectric layer has been removed down to the level of the cathode columns, thereby forming cavities whose bases comprise exposed cathode columns;

depositing a parting layer onto the conductive gate layer and onto the exposed cathode columns;

depositing a conductive layer on the parting layer, material for said conductive layer being directed at said substrate at an oblique angle of incidence while said substrate is rotating about an axis perpendicular to said upper surface, thereby forming cone-shaped microtips inside said cavities; and removing the conductive layer by means of a liftoff process whereby the parting layer on the conductive gate layer is etched and the microtips remain in place.

10. The method of claim 9 wherein the conductive gate layer is phosphorus-doped polysilicon.

11. The method of claim 10 wherein the dielectric layer comprises boron, phosphorus, and silicon oxides and said etchant is taken from the group consisting of trifluoromethane, carbon tetrafluoride, carbon monoxide, and butene gases.

12. The method of claim 11 wherein the concentration of boron is between about 3 and 10 weight % and the concentration of phosphorus is between about 3 and 10 weight %.

13. The method of claim 11 wherein said dielectric layer is formed from ozone, tetraethylorthosilicate, triethylborate, and triethylphosphate, heated to a temperature between about 400 and 600° C. at a pressure between about 100 and 500 Torr.

14. The method of claim 9 wherein the conductive gate layer is deposited to a thickness between about 500 and 5,000 Angstroms.

15. The method of claim 9 wherein the dielectric layer is deposited to a thickness between about 0.5 and 2 microns.

16. The method of claim 9 further comprising etching the cavity in dilute hydrofluoric acid after the cavity has been formed.

17. The method of claim 9 wherein said parting layer is taken from the group consisting of titanium nitride, tungsten nitride, tantalum nitride, and titanium.

18. The method of claim 9 wherein the parting layer is deposited to a thickness between about 500 and 2,000 Angstroms.

19. The method of claim 9 wherein the etchant used to etch the parting layer is dilute hydrofluoric acid or a mix of ammonium hydroxide and ammonium peroxide.

* * * * *